US009021760B2

(12) United States Patent
Kiik et al.

(10) Patent No.: US 9,021,760 B2
(45) Date of Patent: May 5, 2015

(54) LAMINATED ROOFING SHINGLE SYSTEM AND SHINGLES FOR USE THEREIN

(75) Inventors: Matti Kiik, Richardson, TX (US); Larry Scott Reed, Midlothian, TX (US); John Richie McCaskill, Jr., McKinney, TX (US); Michael Allen McLintock, Grapevine, TX (US); Michael L. Bryson, Independence, MO (US); Daniel Coleman DeJarnette, Tuscaloosa, AL (US); Michael Scott Kirk, Tuscaloosa, AL (US)

(73) Assignee: Building Materials Investment Corporation, Wilmington, DE (US)

( * ) Notice: Subject to any disclaimer, the term of this patent is extended or adjusted under 35 U.S.C. 154(b) by 440 days.

(21) Appl. No.: 13/019,573

(22) Filed: Feb. 2, 2011

(65) Prior Publication Data

US 2011/0185668 A1 Aug. 4, 2011

Related U.S. Application Data

(63) Continuation of application No. 12/025,978, filed on Feb. 5, 2008, now abandoned.

(60) Provisional application No. 60/900,408, filed on Feb. 8, 2007.

(51) Int. Cl.
*E04D 1/26* (2006.01)
*E04D 1/00* (2006.01)

(52) U.S. Cl.
CPC ..... *E04D 1/00* (2013.01); *E04D 2001/005* (2013.01); *E04D 1/26* (2013.01)

(58) Field of Classification Search
CPC ..... E04D 1/26; E04D 2001/005; E04D 1/00; B32B 27/06; B32B 2395/00; D06N 7/0089; D06N 5/00
USPC ..... 52/518, 554, 557–559, 585, 543; D25/139
See application file for complete search history.

(56) References Cited

U.S. PATENT DOCUMENTS

| | | | | |
|---|---|---|---|---|
| 1,665,450 | A | 4/1928 | Garber | 52/541 |
| 1,776,949 | A | 9/1930 | Lumbard | |
| 1,860,899 | A | 5/1932 | Miller | 52/521 |
| 2,219,450 | A | 10/1940 | Koenig | 52/547 |
| 2,272,032 | A | 2/1942 | Brown | |
| 2,687,701 | A | 8/1954 | Abraham | 52/543 |
| 3,624,975 | A | 12/1971 | Morgan et al. | 52/105 |
| 3,919,823 | A | 11/1975 | Bradley | 52/557 |
| 3,921,358 | A | 11/1975 | Bettoli | 52/314 |
| 4,262,462 | A | 4/1981 | Melbye | 52/98 |
| 4,274,243 | A * | 6/1981 | Corbin et al. | 52/748.1 |
| 4,333,279 | A | 6/1982 | Corbin et al. | 52/105 |

(Continued)

*Primary Examiner* — Joshua J Michener
*Assistant Examiner* — Kyle Walraed-Sullivan
(74) *Attorney, Agent, or Firm* — Fitzpatrick, Cella, Harper & Scinto

(57) ABSTRACT

A roofing system comprising laminated roofing shingles having a reduced-width headlap portion and a buttlap portion, wherein the roofing system comprises a plurality of courses, and wherein a trailing edge of a subsequently installed shingle in a course overlaps the leading edge of an adjacent previously installed shingle in the same course. The reduced-width headlap portion of the roofing shingles has a width that is less than the width of the buttlap portion. The roofing shingle comprises a first and a second shingle sheet and the lateral edges of the first shingle sheet are aligned with the lateral edges of the second sheet.

7 Claims, 1 Drawing Sheet

(56) References Cited

U.S. PATENT DOCUMENTS

| | | | | |
|---|---|---|---|---|
| 4,466,226 | A | 8/1984 | Rohner | 52/748 |
| 4,527,374 | A | 7/1985 | Corbin | 52/557 |
| 4,587,785 | A | 5/1986 | Rohner | 52/420 |
| 5,369,929 | A | 12/1994 | Weaver | 52/557 |
| 5,611,186 | A | 3/1997 | Weaver | 52/557 |
| 5,666,766 | A | 9/1997 | Markey | 52/94 |
| 5,666,776 | A * | 9/1997 | Weaver et al. | 52/557 |
| 5,822,943 | A | 10/1998 | Frankoski et al. | 52/518 |
| 6,014,847 | A | 1/2000 | Phillips | 52/311.1 |
| 6,105,329 | A * | 8/2000 | Bondoc et al. | 52/557 |
| 6,220,329 | B1 * | 4/2001 | King et al. | 156/512 |
| 6,289,648 | B1 | 9/2001 | Freshwater et al. | 52/557 |
| 6,367,222 | B1 | 4/2002 | Timbrel et al. | 52/555 |
| 6,457,290 | B1 | 10/2002 | Elliott | 52/557 |
| 6,679,020 | B2 | 1/2004 | Becker et al. | 52/518 |
| 6,698,151 | B2 | 3/2004 | Elliott | |
| 6,708,456 | B2 | 3/2004 | Kiik et al. | 52/98 |
| 6,782,671 | B2 | 8/2004 | Timbrel et al. | 52/575 |
| 6,813,866 | B2 * | 11/2004 | Naipawer, III | 52/518 |
| 6,990,779 | B2 | 1/2006 | Kiik et al. | 52/554 |
| 7,204,063 | B2 | 4/2007 | Kandalgaonkar | 52/551 |
| 2003/0172611 | A1 * | 9/2003 | Coco et al. | 52/554 |
| 2004/0111996 | A1 * | 6/2004 | Heroneme | 52/518 |
| 2004/0182032 | A1 | 9/2004 | Koschitzky | 52/518 |
| 2006/0123727 | A1 | 6/2006 | Akins et al. | 52/409 |
| 2007/0039274 | A1 | 2/2007 | Harrington et al. | 52/518 |
| 2007/0042158 | A1 | 2/2007 | Belt et al. | 428/143 |

* cited by examiner

LAMINATED ROOFING SHINGLE SYSTEM AND SHINGLES FOR USE THEREIN

This application is a continuation of application Ser. No. 12/025,978, filed Feb. 5, 2008, which in turn claims priority under 35 U.S.C. §119(e) to application No. 60/900,408, filed Feb. 8, 2007.

FIELD OF THE INVENTION

This invention relates to an improved roofing system and roofing shingles that may be utilized in the roofing system. In particular, the invention relates to the construction of roofing shingles featuring unique dimensions and a roofing system that utilizes the shingles.

BACKGROUND OF THE INVENTION

Asphalt roofing products are often divided into three broad groups: shingles, roll roofing and underlayment. Shingles and roll roofing typically function as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long-term ability to resist weathering and to provide stability under the anticipated temperature extremes. An outer layer of mineral granules is also commonly applied to the asphalt coating to form a surface exposed to the weather which shields the asphalt coating from the sun's rays, adds color to the final product and provides fire resistance.

Typically, shingles are installed on a roof deck such that the shingles are in a row from left to right and the lateral edges of the shingles in the row are contiguous with each other so as to abut each other, i.e. their lateral edges are adjacent to one another. Each row represents a course and the shingles are applied in overlapping courses on the roof deck, wherein the buttlap portion of a subsequent course is placed on the headlap portion of a previous course. The headlap portion of a conventional shingle is at least as wide as the buttlap portion of the shingle so that when the shingles are installed on a roof deck in overlapping courses, the entire buttlap portion of a subsequent course has headlap beneath it. This manner of installation prevents leakage to the roof deck where the lateral edges of the shingles abut each other.

In a typical roofing system, contiguous shingles in a row abut each other at their lateral edges. Thus, when the shingles are exposed to wet weather, it is possible that leakage can occur at the region where the shingles abut. To prevent that, overlapping subsequent rows of shingles are installed in an offset pattern and each shingle's headlap portion is at least as wide as the buttlap portion. Thus, when the shingles are applied to the roof in a plurality of courses and the buttlap portion of a second course of shingles is laid over the headlap portion of a first row of shingles there is always headlap present underneath the regions where the contiguous shingles in a row abut. Any water penetrating the places where lateral edges of shingles abut contacts the headlap rather than the roof deck.

In certain instances, for aesthetic purposes, shingles have been applied to a roof deck such that the lateral edges of neighboring shingles overlap. U.S. Pat. No. 2,687,701 describes single layer tabbed asbestos cement roofing shingles comprising varying length tabs. When the shingles are applied to a roof deck, their lateral edges overlap. The shingles comprise tabs which extend above and over the buttlap portion of a previous course when a subsequent course is installed. The overlapping and varied lengths of tabs are intended to create a more dimensional appearance.

U.S. Pat. No. 3,919,823 describes single layer asphalt roofing shingles. The shingles are not tabbed but instead comprise various projections. The shingles are installed such that their lateral edges overlap to create what is described as a "shadow effect" which will vary depending on the time of day.

U.S. Pat. Nos. 4,333,279 and 4,527,374 describe strip or tabbed single layer asphalt shingles. The shingles comprise various edges at least one of which is an alignment edge. The shingles are overlapped using the alignment edge in order to achieve a desired pattern when the shingles are installed on a roof deck.

U.S. Pat. No. 6,990,779 describes a laminated roofing shingle system including a reduced-width headlap portion and an interply material that is installed under the buttlap portion in order to compensate for the reduced-width headlap portion and provide protection to the roof deck.

U.S. Patent Application Publication 2004/0182032 describes a multi-layer laminate shingle with a reduced-width headlap portion. The shingle has a base layer and at least a second layer above the base layer. At one end of the shingle the base layer projects beyond the second layer while at the other end the second layer projects beyond the base layer. When the shingles are laid in a course along the roof, the projecting end of the second layer overlaps the projecting end of the base layer of the next shingle, forming a shiplap joint over all or substantially all of the width of the shingle.

Each of the above-referenced patents is incorporated herein by reference for all purposes within this application.

SUMMARY OF THE INVENTION

In accordance with the present invention, a roofing system is provided having a multiplicity of courses of laminated roofing shingles having a reduced-width headlap portion wherein the lateral edges of the shingles in a single course overlap adjacent previously installed shingles.

The shingles of the present invention are laminated shingles and have a width (w) and a length (l). The shingles further comprise a headlap portion and a buttlap portion, each having a width and a length, wherein the width of the headlap portion is less than the width of the buttlap portion. In addition, the shingles comprise a leading edge and a trailing edge. In certain embodiments of the invention, the shingles may comprise only a buttlap portion.

When the shingles of the present invention are installed on a roof deck, the trailing edge of a subsequently installed shingle in a course overlaps the leading edge of the adjacent previously installed shingle in the same course to provide an overlap region.

Thus, in accordance with one aspect of the present invention, a roofing system is provided comprising laminated roofing shingles having a reduced-width headlap portion and a buttlap portion and further comprising a leading edge and a trailing edge. The roofing system comprises a plurality of courses. Each course is comprised of a plurality of shingles wherein the trailing edge of a subsequently installed shingle installed in a course overlaps the leading edge of an adjacent previously installed shingle installed in the same course. In a preferred embodiment, the overlap region is about 1 inch to about 6 inches. In a particularly preferred embodiment, the overlap region is about 3 inches.

In a further preferred embodiment, the reduced-width headlap portion of the laminated shingles of the present invention has width that is less than the width of the buttlap portion of the shingle. The headlap portion in certain embodiments may be completely eliminated. In a preferred embodiment, the width of the headlap portion is from about 0% to about 50% the width of the buttlap portion. In a particularly preferred embodiment, the width of the headlap portion is about 10% the width of the buttlap portion.

The laminated shingles of the invention are preferably comprised of conventional asphaltic laminated roofing shingle materials known in the art, provided that the headlap portion of the shingle has a reduced-width. Further, the laminated shingles of the invention comprise a first shingle sheet and a second shingle sheet, wherein the second sheet is attached to the underside of the first shingle sheet, wherein both sheets have substantially the same length, and wherein the lateral edges of the first sheet are substantially aligned with the lateral edges of the second sheet. In a preferred embodiment, the laminated shingle is a laminated shingle described in U.S. Pat. No. 3,921,358, incorporated herein by reference in its entirety, wherein the headlap portion of the shingle has a reduced-width. The laminated shingle as described in U.S. Pat. No. 3,921,358 comprises a first shingle sheet and a second shingle sheet wherein both sheets have substantially the same length, and wherein the lateral edges of the first sheet are aligned with the lateral edges of the second sheet.

DETAILED DESCRIPTION OF THE FIGURES

For a more complete understanding of the present invention, and the advantages thereof, reference is now made to the following descriptions taken in conjunction with the accompanying figures, in which.

DETAILED DESCRIPTION

Figure 1:
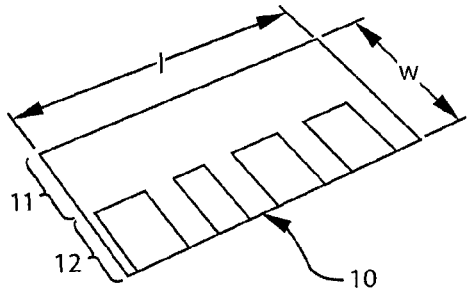
FIG. 1 Prior Art
FIG. 1 shows a prior art laminated roofing shingle.
Figure 2:
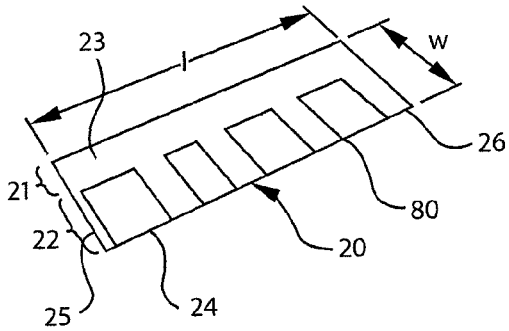
FIG. 2 shows an exemplary embodiment of a laminated roofing shingle of the invention having a reduced-width headlap portion.
Figure 3:
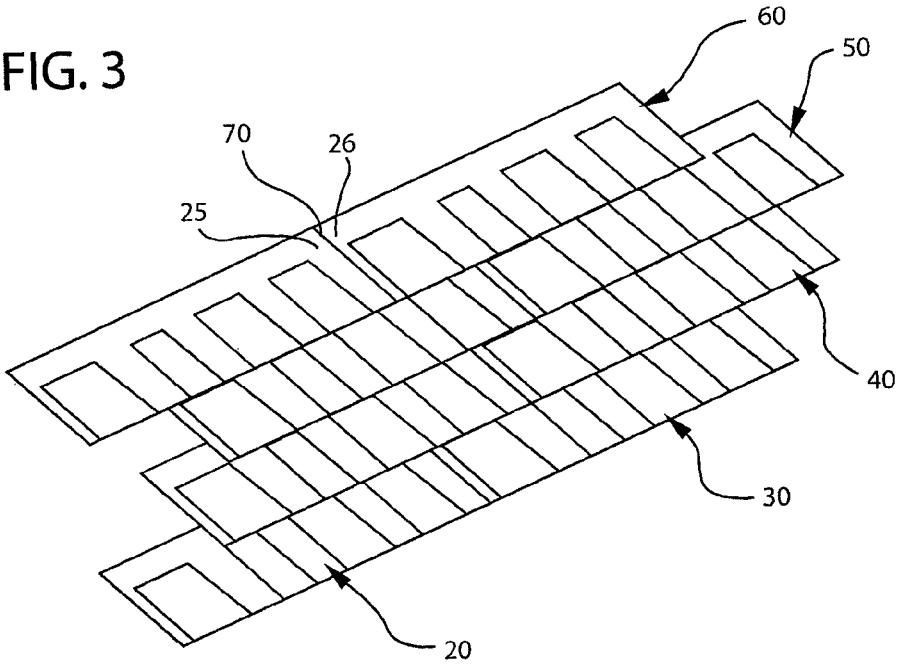
FIG. 3 shows an exemplary embodiment of a roofing system of the invention incorporating the exemplary shingle in FIG. 2.

The preferred embodiments of the present invention and its advantages are best understood by referring to FIGS. 1 through 3, like numerals being used for like and corresponding parts of the various drawings.

FIG. 1 represents a typical roofing shingle 10, wherein the width of the headlap portion 11 is the same or greater than the width of the buttlap portion 12.

A laminated shingle 20 incorporating one embodiment of the present invention is shown in FIGS. 2 and 3. Laminated shingle 20 preferably comprises a reduced-width headlap portion 21 and a buttlap portion 22. The shingles have a width (w) and a length (l) and comprise longitudinal edges 23 and 24, a trailing lateral edge 25 and a leading lateral edge 26.

FIG. 3 shows a roofing system of the invention wherein laminated shingles 20 of the invention are installed on top of one another as they would be applied to a roof deck. The headlap portion 21 lies beneath part of the butt portion 22. The system is comprised of courses of shingles 30, 40, 50, 60, each course comprising a plurality of shingles. When a first course of shingles 30 is applied on a roof deck, the trailing lateral edge 25 of a subsequently installed shingle in a course overlaps the leading lateral edge 36 of an adjacent previously installed shingle in the same course to create an overlap region 70. When a subsequent course of shingles 40 is applied to the roof deck, the butt portion 22 of the shingles in the subsequent course 40 overlap the headlap portion 21 of the shingles in the previous course 30. The butt portion is thus exposed to the weather, while the headlap portion is beneath the butt portion and is not exposed to the weather. Because the width of the headlap portion 21 of the shingle is less than the width of the butt portion 22, or the shingle has no headlap portion, a portion of the butt portion of the subsequently installed course 40 covers the roof deck and a portion covers the headlap portion 21 of the adjacent previously installed course 30. Where there is no headlap portion, the entire butt portion contacts the roof deck.

Referring again to FIG. 2, reduced-width headlap laminated shingle 20 has a generally rectangular configuration defined in part by longitudinal edges 23 and 24 with trailing lateral edge 25 and leading lateral edge 26 disposed therebetween. Longitudinal edge 23 defines the upper edge of the laminated shingle 20. Longitudinal edge 24 defines the lower edge laminated shingle 20.

Depending upon the desired application and appearance of each shingle 20, the buttlap portion may have any desired configuration known in the art, such as a plurality of dragon teeth and spaces. The buttlap portion further comprises a backer strip 80 that is adhered beneath, for example, the dragon teeth. The laminated shingle of the invention may have more than two layers. The skilled artisan will appreciate the many different known laminated shingles that may be used in accordance with the invention. Any laminated shingle is suitable and may be created with a reduced-width headlap for use in the roofing system of the invention. In a preferred embodiment, the laminated shingle comprises a first shingle sheet and a second shingle sheet having substantially the same length. The second shingle sheet is disposed beneath the first shingle sheet. The lateral edges of the first shingle sheet are substantially aligned with the lateral edges of the second shingle sheet.

For one embodiment of the present invention, the reduced-width headlap laminated shingle 20 may be formed from a fiberglass mat (not shown) with an asphalt coating on both sides of the mat. If desired, the present invention may also be used with shingles formed from organic felt or other types of base material, including but not limited to synthetic mats or synthetic glass/hybrid mats having an appropriate coating. Nonlimiting embodiments of coatings include, asphalt and modified bituminous coatings based on atactic polypropylene (APP), styrene-butadiane-styrene (SBS), styrene-ethylene-butadiene-styrene (SEBS), amorphous polyalpha olefin (APAO), thermoplastic polyolefin (TPO), synthetic rubber or other asphaltic modifiers.

Referring to FIG. 2, the exposed outer surface or weather surface, i.e., the buttlap portion 22 of laminated shingle 20 may be coated with various types of mineral granules to protect the asphalt coating, to add color to laminated shingle 20 and to provide fire resistance. For some applications, ceramic-coated mineral granules may be disposed on the top surface of the buttlap portion 22. Also, a wide range of mineral colors from white and black to various shades of red, green, brown and any combination thereof may be used to provide a roof having the desired color for shingle 20. The underside of shingle 20 may be coated with various inert minerals with sufficient consistency to seal the asphalt coating.

An important feature of the present invention includes providing a laminated shingle with a reduced-width headlap portion. For the embodiment of the present invention shown in FIGS. 2 and 3, headlap 21 has a width that is at least 50% less than the width of the buttlap portion 22. The width of the headlap portion 21 may be from about 0% to about 50% the width of the buttlap portion 22. In a particularly preferred embodiment, the width of the headlap portion 21 is about 10% the width of the buttlap portion 22. Generally speaking, the width of the headlap need only be sufficient enough to accommodate a means for securing the laminated shingle 20 to a roof deck. For example, the headlap portion may be only as wide as needed to accommodate nails or an adhesive strip for securing the laminated shingle 20 to a roof deck. In an embodiment wherein the laminated shingle of the invention comprises no headlap, the buttlap portion of the shingle may comprise a means of securing the shingle to the roof deck, such as an adhesive backing.

The reduced-width headlap of the present invention is desirable because it allows for a reduction in the weight of the shingles of the invention, as well as a reduction in the amount and cost of the materials used to make the shingle. The reduced-width headlap is made possible by the presence of overlap region 70, which further protects the roof deck from water leakage.

EXAMPLES

The following Tables illustrate the materials used and the design characteristics for laminated reduced-width headlap shingles made in accordance with the invention. For comparison, Table I shows the materials used to make a conventional laminated shingle, as well as the design characteristics of the shingles. Tables II-IV show the materials used to make shingles in accordance with the invention, with each successive table representing a shingle design with a decreasing headlap portion.

In Table I, the conventional shingle has a headlap portion having a width of 7.625 inches and a buttlap portion (exposure) of 5.625 inches, with an overall shingle width of 13.25 inches and a backer strip width of 6.625 inches. The shingle length is 37.25 inches. The width of the headlap portion in this conventional shingle is approximately 135.6% the width of the buttlap portion. The cost per square foot is $19.003.

Table II represents a shingle made in accordance with the invention having a headlap of 3.25 inches, a buttlap portion (exposure) of 6.5 inches, a backer strip of 7.125 inches and a total shingle width of 9.75 inches. The shingle length is 37 inches. In this embodiment, the width of the headlap is 50% the width of the buttlap portion. The cost per square foot for this shingle is $14.677, which is approximately 23% less than the conventional shingle of Table I.

Table III represents a shingle made in accordance with the invention having a headlap of 3.0 inches, a buttlap portion (exposure) of 6 inches, a backer strip of 6.625 inches and a total shingle width of 9 inches. The shingle length is 36.25 inches. In this embodiment, the width of the headlap is 50% the width of the buttlap portion. The cost per square foot for this shingle is $14.966, which is approximately 21% less than the conventional shingle of Table I.

Table IV represents a shingle made in accordance with the invention having a headlap of 2.813 inches, a buttlap portion (exposure) of 5.625 inches, a backer strip of 6.25 inches and a total shingle width of 8.438 inches. The shingle length is 37.25 inches. In this embodiment, the width of the headlap is 50% the width of the buttlap portion. The cost per square foot for this shingle is $13.732, which is approximately 28% less than the conventional shingle of Table I.

TABLE I

| | Min Lbs/Sq | Model Lbs/Sq | Est. $/Lb | Min $/Sq | Model $/Sq | Lbs/Sq @110% to Min | $/Sq @110% to Min |
|---|---|---|---|---|---|---|---|
| MAT | 4.85 | 4.97 | 0.7431 | 3.603 | 3.695 | 5.31 | 3.946 |
| INTERPLY | 0.00 | 0.00 | 0.0000 | 0.000 | 0.000 | 0.00 | 0.000 |
| ASPHALT | 37.75 | 38.79 | 0.1984 | 7.490 | 7.695 | 41.42 | 8.217 |
| SBS | 0.00 | 0.00 | 0.7500 | 0.000 | 0.000 | 0.00 | 0.000 |
| FILLER | 64.28 | 67.48 | 0.0112 | 0.723 | 0.759 | 72.05 | 0.810 |
| F/C TOTAL | 102.04 | 106.27 | | | | 113.47 | |
| F/C FRONT | 79.25 | 83.48 | | | | 89.14 | |
| F/C BACK | 22.78 | 22.78 | | | | 24.33 | |
| BUTTLAP GRANULES | 43.32 | 48.99 | 0.0450 | 1.947 | 2.202 | 52.31 | 2.352 |
| COPPER GRANULES | 1.20 | 1.22 | 0.2991 | 0.359 | 0.364 | 1.30 | 0.389 |
| HEADLAP | 45.51 | 41.17 | 0.0249 | 1.132 | 1.024 | 43.96 | 1.094 |
| GRAND TOTAL | 90.03 | 91.38 | | | | 97.58 | |
| BACKING | 14.21 | 14.43 | 0.0190 | 0.270 | 0.274 | 15.40 | 0.292 |
| SUNSEAL | 1.10 | 1.12 | 0.2645 | 0.291 | 0.295 | 1.19 | 0.315 |
| ADHESIVE | 1.65 | 1.67 | 0.2645 | 0.436 | 0.443 | 1.79 | 0.473 |
| REL AGENT | 0.00 | 0.00 | 0.0000 | 0.000 | 0.000 | 0.00 | 0.000 |
| TAPE | 0.07 | 0.07 | 1.8501 | 0.130 | 0.099 | 0.08 | 0.141 |
| WRAPS | 2.01 | 2.05 | 0.4286 | 0.861 | 0.769 | 2.19 | 0.938 |
| WRAPSEAL | 0.04 | 0.04 | 0.8197 | 0.033 | 0.033 | 0.04 | 0.036 |
| TOTAL | 216.00 | 222.00 | | 17.276 | 17.654 | 237.05 | $19.003 |
| FILLER % | 63.00% | 63.50% | | | | | |
| % SBS | 0.00% | 0.00% | | | | | |
| HEAD/BUTTLAP ACT | 50.55% | 45.05% | | | | 1.0678 | |
| HL IN SHIM | 0.00% | 0.00% | | | | | |
| MAT WEIGHT | 1.60 | 1.60 | | | | | |

TABLE I-continued

| | Min Lbs/Sq | Model Lbs/Sq | Est. $/Lb | Min $/Sq | Model $/Sq | Lbs/Sq @110% to Min | $/Sq @110% to Min |
|---|---|---|---|---|---|---|---|
| INTERPLY WEIGHT | 0.00 | 0.00 | | | | | |
| % to Minimum | | 102.78% | | | 102.19% | 109.75% | 110.00% |

Design Characteristics

| | | | | |
|---|---|---|---|---|
| Exposure-in | 5.625 | Interply Ratio-CSF/Sq | 0.000 | |
| Shingle Length-in | 38.750 | Interply Width | 0.000 | |
| Shingle Width-in | 13.250 | Interply Lbs/Sq | 0.000 | |
| Backer Width-in | 6.625 | Lineal Ft/Sq | 53.281 | |
| Common Bond-in | 1.000 | SPH/FPM | 1.126 | |
| Shim Width-in | NA | | L | W |
| Headlap Width-in | 7.625 | Pallet Stack Layer 1 & 3 | 52.00 | 39.75 |
| Web Width-in | 68.250 | Pallet Stack Layer 2 | 53.00 | 38.75 |
| Exposure-Sq Ft | 99.902 | Squares/Pallet | 16 | |
| Web Sq Ft/Sq | 303.037 | Bundles/Pallet | 48 | |
| Shingles/Bundle | 22.000 | Layers/Pallet | 12.000 | |
| Bundles/Sq | 3.000 | Pallet Wt-lbs | 3552.000 | |
| Shingles/Sq | 66.000 | | | |
| Web Lbs/Sq | 222.000 | Adj. Lbs/Bundle | 74.000 | |
| Asphalt Lbs/CSF | 12.800 | Adj. Lbs/Sq | 222.000 | |
| Web Lbs/CSF | 73.258 | | | |

TABLE II

| | Min Lbs/Sq | Model Lbs/Sq | Est. $/Lb | Min $/Sq | Model $/Sq | Lbs/Sq @ 110% to Min | $/Sq @ 110% to Min |
|---|---|---|---|---|---|---|---|
| MAT | 3.58 | 3.68 | 0.7431 | 2.664 | 2.732 | 3.90 | 2.900 |
| INTERPLY | 0.00 | 0.00 | 0.0000 | 0.000 | 0.000 | 0.00 | 0.000 |
| ASPHALT | 27.25 | 28.59 | 0.1984 | 5.406 | 5.672 | 30.35 | 6.021 |
| SBS | 0.00 | 0.00 | 0.7500 | 0.000 | 0.000 | 0.00 | 0.000 |
| FILLER | 46.39 | 49.74 | 0.0112 | 0.522 | 0.559 | 52.79 | 0.594 |
| F/C TOTAL | 73.64 | 78.32 | | | | 83.14 | |
| F/C FRONT | 50.86 | 55.54 | | | | 58.96 | |
| F/C BACK | 22.78 | 22.78 | | | | 24.18 | |
| BUTTLAP | 49.49 | 52.09 | 0.0450 | 2.225 | 2.342 | 55.29 | 2.486 |
| GRANULES | | | | | | | |
| COPPER GRANULES | 1.20 | 1.22 | 0.2991 | 0.359 | 0.364 | 1.29 | 0.387 |
| HEADLAP | 15.88 | 14.26 | 0.0249 | 0.395 | 0.355 | 15.13 | 0.376 |
| GRAND TOTAL | 66.57 | 67.56 | | | | 71.72 | |
| BACKING | 10.51 | 10.67 | 0.0190 | 0.199 | 0.202 | 11.32 | 0.215 |
| SUNSEAL | 1.10 | 1.12 | 0.2645 | 0.291 | 0.295 | 1.19 | 0.313 |
| ADHESIVE | 1.65 | 1.67 | 0.3306 | 0.546 | 0.554 | 1.78 | 0.588 |
| REL AGENT | 0.00 | 0.00 | 0.0000 | 0.000 | 0.000 | 0.00 | 0.000 |
| TAPE | 0.07 | 0.07 | 1.8501 | 0.130 | 0.099 | 0.08 | 0.140 |
| WRAPS | 1.34 | 1.37 | 0.4286 | 0.574 | 0.513 | 1.45 | 0.622 |
| WRAPSEAL | 0.04 | 0.04 | 0.8197 | 0.033 | 0.033 | 0.04 | 0.035 |
| TOTAL | 158.50 | 164.50 | | 13.343 | 13.721 | 174.62 | $14.677 |
| FILLER % | 63.00% | 63.50% | | | | | |
| % SBS | 0.00% | 0.00% | | | | | |
| HEAD/BUTTLAP ACT | 23.85% | 21.10% | | | | 1.0615 | |
| HL IN SHIM | 0.00% | 0.00% | | | | | |
| MAT WEIGHT | 1.60 | 1.60 | | | | | |
| INTERPLY WEIGHT | 0.00 | 0.00 | | | | | |
| % to Minimum | | 103.79% | | | 102.83% | 110.17% | 110.00% |

Design Characteristics

| | | | | |
|---|---|---|---|---|
| Exposure-in | 6.500 | Interply Ratio-CSF/Sq | 0.000 | |
| Shingle Length-in | 37.000 | Interply Width | 0.000 | |
| Shingle Width-in | 9.750 | Interply Lbs/Sq | 0.000 | |
| Backer Width-in | 7.125 | Lineal Ft/Sq | 49.333 | |
| Common Bond-in | 0.625 | SPH/FPM | 1.216 | |
| Shim Width-in | NA | | L | W |
| Headlap Width-in | 3.250 | Pallet Stack Layer 1 & 3 | 46.75 | 37.00 |
| Web Width-in | 54.500 | Pallet Stack Layer 2 | 48.75 | 37.00 |
| Exposure-Sq Ft | 98.222 | Squares/Pallet | 22.50 | |

TABLE II-continued

| | Min Lbs/Sq | Model Lbs/Sq | Est. $/Lb | Min $/Sq | Model $/Sq | Lbs/Sq @ 110% to Min | $/Sq @ 110% to Min |
|---|---|---|---|---|---|---|---|
| Web Sq Ft/Sq | 224.056 | Bundles/Pallet | | | 45 | | |
| Shingles/Bundle | 32.000 | Layers/Pallet | | | 10.000 | | |
| Bundles/Sq | 2.000 | Pallet Wt-lbs | | | 3701.250 | | |
| Shingles/Sq | 64.000 | | | | | | |
| Web Lbs/Sq | 164.500 | Adj. Lbs/Bundle | | | 82.250 | | |
| Asphalt Lbs/CSF | 12.759 | Adj. Lbs/Sq | | | 164.500 | | |
| Web Lbs/CSF | 73.419 | | | | | | |

TABLE III

| | Min Lbs/Sq | Model Lbs/Sq | Est. $/Lb | Min $/Sq | Model $/Sq | Lbs/Sq @ 110% to Min | $/Sq @ 110% to Min |
|---|---|---|---|---|---|---|---|
| MAT | 3.66 | 3.76 | 0.7431 | 2.721 | 2.791 | 3.99 | 2.964 |
| INTERPLY | 0.00 | 0.00 | 0.0000 | 0.000 | 0.000 | 0.00 | 0.000 |
| ASPHALT | 27.91 | 29.23 | 0.1984 | 5.537 | 5.799 | 31.04 | 6.158 |
| SBS | 0.00 | 0.00 | 0.7500 | 0.000 | 0.000 | 0.00 | 0.000 |
| FILLER | 47.52 | 50.85 | 0.0112 | 0.534 | 0.572 | 54.00 | 0.607 |
| F/C TOTAL | 75.42 | 80.08 | | | | 85.04 | |
| F/C FRONT | 52.64 | 57.29 | | | | 60.85 | |
| F/C BACK | 22.78 | 22.78 | | | | 24.20 | |
| BUTTLAP GRANULES | 50.63 | 53.44 | 0.0450 | 2.276 | 2.402 | 56.75 | 2.551 |
| COPPER GRANULES | 1.20 | 1.22 | 0.2991 | 0.359 | 0.364 | 1.29 | 0.387 |
| HEADLAP | 16.15 | 14.35 | 0.0249 | 0.402 | 0.357 | 15.24 | 0.379 |
| GRAND TOTAL | 67.98 | 69.00 | | | | 73.28 | |
| BACKING | 10.73 | 10.89 | 0.0190 | 0.204 | 0.207 | 11.57 | 0.219 |
| SUNSEAL | 1.10 | 1.12 | 0.2645 | 0.291 | 0.295 | 1.19 | 0.314 |
| ADHESIVE | 1.65 | 1.67 | 0.3306 | 0.546 | 0.554 | 1.78 | 0.588 |
| REL AGENT | 0.00 | 0.00 | 0.0000 | 0.000 | 0.000 | 0.00 | 0.000 |
| TAPE | 0.07 | 0.07 | 1.8501 | 0.130 | 0.099 | 0.08 | 0.140 |
| WRAPS | 1.34 | 1.37 | 0.4286 | 0.574 | 0.513 | 1.45 | 0.622 |
| WRAPSEAL | 0.04 | 0.04 | 0.8197 | 0.033 | 0.033 | 0.04 | 0.035 |
| TOTAL | 162.00 | 168.00 | | 13.605 | 13.986 | 178.42 | $14.965 |
| FILLER % | 63.00% | 63.50% | | | | | |
| % SBS | 0.00% | 0.00% | | | | | |
| HEAD/BUTTLAP ACT | 23.76% | 20.79% | | | | 1.062 | |
| HL IN SHIM | 0.00% | 0.00% | | | | | |
| MAT WEIGHT | 1.60 | 1.60 | | | | | |
| INTERPLY WEIGHT | 0.00 | 0.00 | | | | | |
| % to Minimum | | 103.70% | | | 102.80% | 110.13% | 110.00% |

Design Characteristics

| | | | | |
|---|---|---|---|---|
| Exposure-in | 6.000 | Interply Ratio-CSF/Sq | 0.000 | |
| Shingle Length-in | 36.250 | Interply Width | 0.000 | |
| Shingle Width-in | 9.000 | Interply Lbs/Sq | 0.000 | |
| Backer Width-in | 6.625 | Lineal Ft/Sq | 36.250 | |
| Common Bond-in | 0.625 | SPH/FPM | 1.655 | |
| Shim Width-in | NA | | L | W |
| Headlap Width-in | 3.000 | Pallet Stack Layer 1 & 3 | 45.25 | 36.25 |
| Web Width-in | 75.750 | Pallet Stack Layer 2 | 45.00 | 36.25 |
| Exposure-Sq Ft | 99.750 | Squares/Pallet | 22.50 | |
| Web Sq Ft/Sq | 228.828 | Bundles/Pallet | 45 | |
| Shingles/Bundle | 36.000 | Layers/Pallet | 10.000 | |
| Bundles/Sq | 2.000 | Pallet Wt-lbs | 3780.000 | |
| Shingles/Sq | 72.000 | | | |
| Web Lbs/Sq | 168.000 | Adj. Lbs/Bundle | 84.000 | |
| Asphalt Lbs/CSF | 12.773 | Adj. Lbs/Sq | 168.000 | |
| Web Lbs/CSF | 73.418 | | | |

TABLE IV

| | Min Lbs/Sq | Model Lbs/Sq | Est. $/Lb | Min $/Sq | Model $/Sq | Lbs/Sq @ 110% to Min | $/Sq @ 110% to Min |
|---|---|---|---|---|---|---|---|
| MAT | 3.34 | 3.43 | 0.7431 | 2.484 | 2.547 | 3.63 | 2.696 |
| INTERPLY | 0.00 | 0.00 | 0.0000 | 0.000 | 0.000 | 0.00 | 0.000 |
| ASPHALT | 25.01 | 26.41 | 0.1984 | 4.963 | 5.241 | 27.95 | 5.546 |
| SBS | 0.00 | 0.00 | 0.7500 | 0.000 | 0.000 | 0.00 | 0.000 |
| FILLER | 42.59 | 45.95 | 0.0112 | 0.479 | 0.517 | 48.63 | 0.547 |
| F/C TOTAL | 67.60 | 72.37 | | | | 76.59 | |
| F/C FRONT | 44.82 | 49.59 | | | | 52.48 | |
| F/C BACK | 22.78 | 22.78 | | | | 24.11 | |
| BUTTLAP GRANULES | 46.16 | 48.84 | 0.0450 | 2.075 | 2.196 | 51.69 | 2.324 |
| COPPER GRANULES | 1.20 | 1.22 | 0.2991 | 0.359 | 0.364 | 1.29 | 0.386 |
| HEADLAP | 14.70 | 12.93 | 0.0249 | 0.366 | 0.322 | 13.68 | 0.340 |
| GRAND TOTAL | 62.06 | 62.99 | | | | 66.66 | |
| BACKING | 9.80 | 9.94 | 0.0190 | 0.186 | 0.189 | 10.52 | 0.200 |
| SUNSEAL | 1.10 | 1.12 | 0.2645 | 0.291 | 0.295 | 1.18 | 0.313 |
| ADHESIVE | 1.65 | 1.67 | 0.3306 | 0.546 | 0.554 | 1.77 | 0.586 |
| REL AGENT | 0.00 | 0.00 | 0.0000 | 0.000 | 0.000 | 0.00 | 0.000 |
| TAPE | 0.07 | 0.07 | 1.8501 | 0.130 | 0.099 | 0.08 | 0.140 |
| WRAPS | 1.34 | 1.37 | 0.4286 | 0.574 | 0.513 | 1.45 | 0.620 |
| WRAPSEAL | 0.04 | 0.04 | 0.8197 | 0.033 | 0.033 | 0.04 | 0.035 |
| TOTAL | 147.00 | 153.00 | | 12.484 | 12.869 | 161.92 | $13.732 |
| FILLER % | 63.00% | 63.50% | | | | | |
| % SBS | 0.00% | 0.00% | | | | | |
| HEAD/BUTTLAP ACT | 23.68% | 20.53% | | | | 1.0583 | |
| HL IN SHIM | 0.00% | 0.00% | | | | | |
| MAT WEIGHT | 1.60 | 1.60 | | | | | |
| INTERPLY WEIGHT | 0.00 | 0.00 | | | | | |
| % to Minimum | | 104.08% | | | 103.09% | 110.15% | 110.00% |

Design Characteristics

| | | | | |
|---|---|---|---|---|
| Exposure - in | 5.625 | Interply Ratio-CSF/Sq | 0.000 | |
| Shingle Length-in | 37.250 | Interply Width | 0.000 | |
| Shingle Width-in | 8.438 | Interply Lbs/Sq | 0.000 | |
| Backer Width-in | 6.250 | Lineal Ft/Sq | 52.771 | |
| Common Bond-in | 0.625 | SPH/FPM | 1.137 | |
| Shim Width-in | NA | | L | W |
| Headlap Width-in | 2.813 | Pallet Stack Layer 1 & 3 | 45.69 | 37.25 |
| Web Width-in | 47.500 | Pallet Stack Layer 2 | 42.19 | 37.25 |
| Exposure-Sq Ft | 98.945 | Squares/Pallet | 24.50 | |
| Web Sq Ft/Sq | 208.885 | Bundles/Pallet | 49 | |
| Shingles/Bundle | 34.000 | Layers/Pallet | 10.000 | |
| Bundles/Sq | 2.000 | Pallet Wt-lbs | 3748.500 | |
| Shingles/Sq | 68.000 | | | |
| Web Lbs/Sq | 153.000 | Adj. Lbs/Bundle | 76.500 | |
| Asphalt Lbs/CSF | 12.646 | Adj. Lbs/Sq | 153.000 | |
| Web Lbs/CSF | 73.246 | | | |

It should be understood that the above examples are illustrative, and that compositions other than those described above can be used while utilizing the principles underlying the present invention.

What is claimed is:

1. A roofing system consisting essentially of laminated shingles having headlap portions and buttlap portions, wherein the roofing system comprises a plurality of courses of shingles, and wherein a trailing lateral edge of a subsequently installed shingle in a first course of shingles overlaps a leading lateral edge of an adjacent previously installed shingle in the first course to provide an overlap region, wherein the laminated shingle consists essentially of a first and a second shingle sheet, wherein lateral edges of the first sheet are substantially aligned with lateral edges of the second sheet, wherein the width of the headlap portion is smaller than the width of the buttlap portion, thereby forming a reduced-width headlap portion, and wherein an interply material does not compensate for the reduced-width headlap portion to provide protection to a roof deck.

2. The roofing system according to claim 1, wherein the buttlap portion of the laminated shingle includes an exposed buttlap portion, and wherein the width of the headlap portion is smaller than the width of the exposed buttlap portion.

3. The roofing system according to claim 1, wherein the width of the headlap portion is from about 0% to about 50% of the width of the buttlap portion.

4. The roofing system according to claim 1, wherein the width of the headlap portion is about 10% of the width of the buttlap portion.

5. The roofing system according to claim 1, wherein the overlap region is from about 1 inch to about 6 inches.

6. The roofing system according to claim 5, wherein the overlap region is about 3 inches.

7. The roofing system according to claim 1, 2, 3, 4, 5 or 6 further comprising a subsequently installed course of shingles, wherein the buttlap portion of the subsequently installed course of shingles covers the headlap portion of a previously installed course of shingles.

* * * * *